US008348725B2

(12) United States Patent
Clay

(10) Patent No.: US 8,348,725 B2
(45) Date of Patent: Jan. 8, 2013

(54) GRINDING AND HONING FIXTURE WITH CLAMPING JAWS

(76) Inventor: Tymen Clay, Stratford (CA)

( * ) Notice: Subject to any disclaimer, the term of this patent is extended or adjusted under 35 U.S.C. 154(b) by 852 days.

(21) Appl. No.: 12/489,553

(22) Filed: Jun. 23, 2009

(65) Prior Publication Data

US 2009/0318066 A1 Dec. 24, 2009

(30) Foreign Application Priority Data

Jun. 23, 2008 (CA) ..... 2635614

(51) Int. Cl.
*B24B 41/06* (2012.01)

(52) U.S. Cl. ..... 451/380; 269/218; 269/249; 451/224; 451/229; 451/234; 451/293; 451/321; 451/371; 451/387

(58) Field of Classification Search ..... 29/257, 29/267; 269/3, 6, 143, 218, 240, 249; 451/224, 451/229, 234, 293, 321, 367, 369, 371, 380, 451/387, 405

See application file for complete search history.

(56) References Cited

U.S. PATENT DOCUMENTS

| | | | | | |
|---|---|---|---|---|---|
| 2,107,921 | A | | 2/1938 | Weed | |
| 2,153,476 | A | | 3/1938 | Nickle | |
| 3,482,325 | A | | 12/1969 | Mitchell | |
| 3,512,309 | A | | 5/1970 | Grieco | |
| 3,881,888 | A | | 5/1975 | Schwab | |
| 3,934,316 | A | * | 1/1976 | Driscoll | 24/486 |
| 4,234,176 | A | * | 11/1980 | Goff et al. | 269/156 |
| 4,502,457 | A | | 3/1985 | Marron | |
| 4,716,688 | A | | 1/1988 | Reiling et al. | |
| 4,748,775 | A | | 6/1988 | Imahashi | |
| 4,962,918 | A | * | 10/1990 | Yang | 269/156 |
| 5,157,870 | A | * | 10/1992 | Pike | 451/273 |
| 5,301,473 | A | | 4/1994 | Seear | |
| 5,527,208 | A | * | 6/1996 | Blake et al. | 451/367 |
| 6,393,712 | B1 | | 5/2002 | Jansson | |
| 6,764,383 | B1 | | 7/2004 | Chandler et al. | |
| 6,935,937 | B2 | | 8/2005 | Port | |
| 7,451,968 | B2 | * | 11/2008 | Geldert | 269/258 |
| 2008/0064309 | A1 | | 3/2008 | Stanley | |

OTHER PUBLICATIONS

U.S. Appl. No. 60/648,434, Clay, Tymen.
Fine Woodworking Tools, 2000/2001; Lee Valley, pp. 149-151.

* cited by examiner

*Primary Examiner* — Timothy V Eley
(74) *Attorney, Agent, or Firm* — Gifford, Krass, Sprinkle, Anderson & Citkowski, P.C.

(57) ABSTRACT

A blade holding jig arrangement for either grinding or honing a blade including a mounting bracket assembly with an elongate guide bar and a device for rigidly supporting the guide bar. A support arm can be pivotally mounted on the guide bar by means of a tubular support mounted on one end of the arm and extending perpendicular thereto. The guide bar extends through a passageway in the tubular support. The support arm can be moved along the guide bar for grinding. A clamp unit for clamping a blade includes a U-bracket with two legs and two clamping jaws adjustably mounted on the U-bracket between the legs. The clamp unit is attached to an end section of the arm remote from the one end of the arm. The clamping jaws can be moved towards one another in order to clamp the blade.

20 Claims, 10 Drawing Sheets

GRINDING AND HONING FIXTURE WITH CLAMPING JAWS

CROSS-REFERENCE TO RELATED APPLICATION

This application claims priority of Canadian Patent Application No. 2,635,614 filed Jun. 23, 2008.

BACKGROUND OF THE INVENTION

This invention relates to fixtures and devices for holding a blade of a tool such as a chisel or plane iron, for purposes for grinding or honing the blade.

A tool having a blade must be sharpened from time to time in order for it to work properly and efficiently. A wide variety of tools with blades that require sharpening are known and these include chisels used in woodworking and plane irons used in planning tools. The width of the blade to be sharpened can vary between less than one half inch to two to three inches or more. Generally, the sharpening operation can include the basic steps of grinding a basic bevel angle on the edge of the blade using a grinding wheel. Then, in order to obtain a particularly sharp edge on the blade, a honing stone is used to hone a microbevel at a slightly different angle than the basic bevel angle which has been ground. Since the secondary bevel is small, the person sharpening the tool will remove less steel and arrive at a sharp edge quickly. However, in the past, it has generally required considerable skill for a person to sharpen such tools with a microbevel without causing any damage to the blade. This is particularly true for a longer blade edge of two, three or more inches since it can be difficult to hold the blade at the correct orientation both for the grinding step and the honing step.

One known sharpening system marketed by Lee Valley Tools Ltd., of Ottawa, Ontario, Canada, is a honing guide and angle jig set sold under the registered trade-mark VERITAS. This known apparatus includes a flat metal support plate on which a five-sided angle setting wheel is bolted near one end of the plate. Each side or facet of the wheel provides a different selected angle for the blade to be sharpened. The blade is mounted in a clamping device which has an opening to receive a central portion of the blade and a clamping bolt that engages the side of the blade. Mounted on the bottom of the clamping device is a wide roller which is arranged on an adjustable cam shaft. With this rolling jig, the blade to be sharpened can be rolled back and forth along a honing stone at the correct angle to form the desired micro-bevel. Although this known jig set may be satisfactory for forming the microbevel on the blade, it is not well suited for creating or grinding the basic bevel angle for the tool prior to the honing operation.

There has also been developed by the applicant an apparatus which can be used for both grinding and honing the blade of a tool, this apparatus being described in more detail hereinafter and illustrated in the FIGS. 1 to 5. This prior art apparatus includes a clamping mechanism for holding the blade, which is mounted on a pivotal elongate arm extending in a first plane. The arm is mounted on a tubular support member which has a passage formed therein. The central axis of this passage defines a pivot axis perpendicular to the first plane. This known apparatus includes a mounting bar device with an elongate mounting bar on which the tubular support member can be mounted for a grinding operation. The mounting bar device includes an adjustable base or support mountable on a workbench. During a grinding operation with a grinding wheel, the adjustable support rigidly holds the mounting bar so that the bar and the tubular support member extend parallel to the axis of rotation of the grinding wheel. The support member can be moved along die bar and rotated on the bar during grinding.

Although the above described grinding and honing apparatus works satisfactory for its intended purpose and can be used for both grinding and honing, there are some aspects of the apparatus which can cause difficulty for some users. For example, the clamping mechanism of this known apparatus can make it difficult to sharpen a short tool or blade. In addition there is no provision in this apparatus for self squaring of the tool or blade in the clamping mechanism, thus necessitating extra care to ensure that the tool or blade is properly oriented in the clamping mechanism. Furthermore, it can be difficult to set the blade in the clamping mechanism so that it extends parallel to the grinding surface of the grinding wheel as desired without having to make careful, time consuming adjustments to the position of the blade in the clamping mechanism or without manufacturing the apparatus to very precise tolerances.

There is provided and described herein an improved blade holding jig for grinding a blade with a grinding machine, this jig employing a clamp unit with a U-bracket having two spaced-apart legs and two clamping jaws adjustably mounted on the U-bracket between the legs. The clamping jaws can be moved towards one another to firmly clamp the blade or moved away from one another to release the blade.

Also a main part of the blade holding jig described herein can be used for honing a blade to provide a sharp edge. In an exemplary version of this blade holding jig used for honing, an attachment mechanism adjustably connects one of the legs of the U-bracket to an end section of the arm member which is opposite the end on which the tubular support member of the support arm mechanism is mounted. Using this jig for honing, the clamp unit and the blade clamped therein can be set at a desired angle for the honing operation by using the attachment mechanism.

SUMMARY OF THE PRESENT DISCLOSURE

According to one aspect of the invention, a blade holding jig for grinding a blade with a grinding machine includes a mounting bracket assembly with an elongate guide bar and a support device for rigidly supporting the guide bar. The jig has a support arm mechanism adapted to be pivotally mounted on the guide bar. The support arm mechanism includes an elongate arm having a longitudinal axis and a tubular support member rigidly mounted to one end of the arm and extending perpendicular to the longitudinal axis. The tubular support member forms a guide passageway through which the guide bar extends during use of the jig for a grinding operation. The support arm mechanism is slidable on the guide bar during use of the jig. A clamp unit capable of clamping the blade for the grinding operation is attached to an end section of the arm remote from the one end of the arm and includes a U-bracket with two spaced-apart legs and two clamping jaws adjustably mounted on the U-bracket between the legs so that the clamping jaws can be moved towards one another to firmly clamp the blade or moved away from one another to release the blade.

According to an exemplary embodiment, the U-bracket is adjustably connected to the end section of the arm by an attachment mechanism defining a pivot access extending perpendicular to the arm so that, during use of the jig for grinding, the clamp unit and the blade can be set at a desired angle for the grinding operation by using the attachment mechanism to adjust the angular position of the clamp unit about the pivot axis to the desired angle.

According to another embodiment of the invention, a blade holding jig for honing a blade to provide a sharp edge includes a support arm mechanism having an elongate arm member with a first longitudinal axis and a tubular support member mounted on one end of the arm member and defining a central, second longitudinal axis which is perpendicular to the first longitudinal axis. The jig further includes a clamp unit for clamping the blade during a honing process, this unit including a U-bracket with two spaced-apart legs rigidly connected by a bracket end section and two clamping jaws adjustably mounted on the U-bracket between the legs so that the clamping jaws can be moved towards one another to firmly clamp the blade in a position suitable for honing or moved away for one another to release the blade. An attachment mechanism is provided for adjustably connecting one of the legs to an end section of the arm member located opposite the one end. During use of the jig for honing, the clamp unit and the blade clamped therein can be set at a desired angle for the honing operation by using the attachment mechanism.

In an exemplary version of this jig, at least one roller is mounted on the support arm mechanism adjacent the one end of the arm member and has an axis of rotation parallel to the second longitudinal axis. The at least one roller rotatably engages a flat support surface in order to hold the jig in a desired orientation during the honing operation.

In another embodiment of the invention, a blade holding jig for grinding a blade with a grinding machine includes a mounting bracket assembly comprising a guide bar member having an elongate guard bar and a rocker plate fixedly mounted on one end of the guide bar and extending perpendicular thereto. The assembly includes a support device for rigidly supporting the guide bar member, this support device comprising an angular support member with a substantially flat leg section extending in a plane and connected to the rocker plate by an adjustment mechanism whereby the rocker plate can be angularly adjusted relative to the plane of the leg section, thereby altering a direction in which the guide bar extends. The jig also has a support arm mechanism adapted to be pivotally mounted on the guide bar, this mechanism including an elongate arm and a tubular support member rigidly mounted on one end of the arm and extending perpendicular thereto. The tubular support member forms a passage through which the guide bar extends during use of the jig for a grinding operation. The jig also has a clamp unit capable of clamping the blade and connected to an end section of the arm opposite the one end of the arm.

In an exemplary version of this jig, the adjustment mechanism comprises a plurality of adjustable screws distributed about a central pivot point of the rocker plate and connecting the rocker plate to the leg section. In this version, the rocker plate can be angularly adjusted by turning one or more of the screws.

Further features and advantages of the present blade holding jig will become apparent from the following detailed description of an exemplary embodiment taken in conjunction with the drawings.

DETAILED DESCRIPTION OF EXEMPLARY EMBODIMENT(S)

Figure 1:
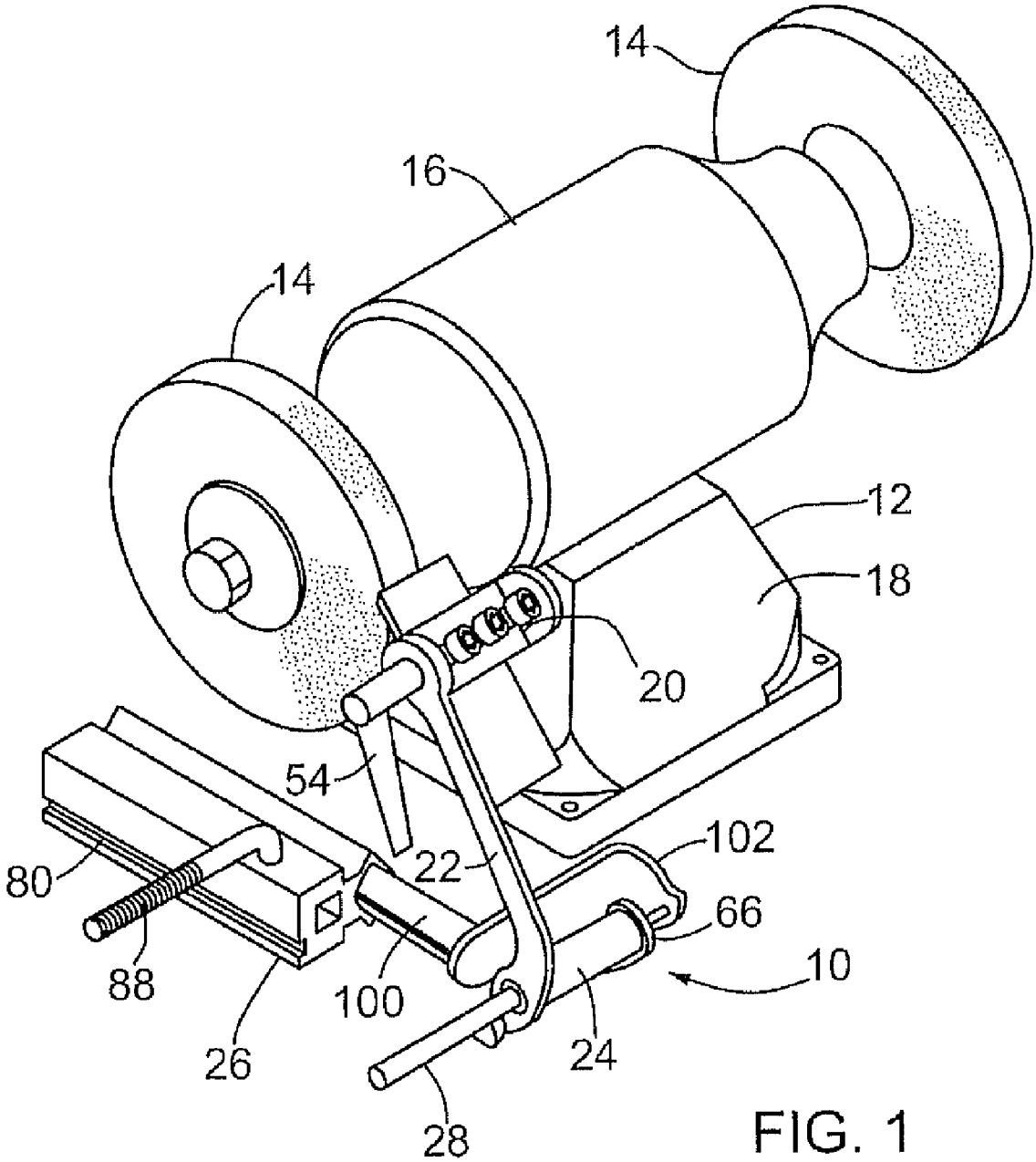
FIG. 1 (PRIOR ART)
FIG. 1 is a perspective view illustrating a prior art grinding honing fixture being used in conjunction with a grinding machine, this view being taken from above and from the front.

FIGS. 1 to 5 illustrate a prior art grinding and honing fixture 10 and illustrate both its construction and use. This known fixture 10 can be mounted on a bench or other suitable support surface next to a standard grinding machine 12 which can have one or two grinding wheels 14. In a known manner, the wheels are rotated at a high rate of speed by a motor such as the illustrated electrical motor 16. The motor can be mounted on a rigid machine base 18 which can be mounted on the work bench or other suitable support. The grinding wheels are made of a highly abrasive material suitable for grinding the blade of a metal tool.

The known fixture 10 includes a clamping mechanism 20 able to clamp the tool or tool blade for the grinding operation, a pivotal, elongate arm 22 on which the clamping mechanism is mounted, and a tubular support member 24 extending from and connected to the arm. The fixture 10 also includes a mounting bar device 26 which is only used when the fixture is being used for grinding. The device 26 includes an elongate mounting bar or rod 28 having a circular cross section. This bar is slidable in an elongate, open ended passage formed by the support member 24.

The clamping mechanism of this fixture includes a U-bracket 32 with two upstanding parallel legs and a connecting section extending between the legs. Extending between the legs is a flat clamp plate 40 which can be welded to the legs. A blade receiving slot 42 is formed between this plate and the connection section of the bracket. A cutting tool such as the illustrated plane iron 44 can be placed in the slot and secured therein by clamping bolts 46.

There can be arranged on a rounded upper end of one of the legs a series of graduations or markings 50 that can be used to set the angular orientation of the clamping mechanism 20 relative to the arm 22. These markings are provided on the semi-circular top of the leg and an indicator or a mark 52 can be provided on a rounded front end of the arm adjacent to the markings 50.

In order to adjust to the angle of is known clamping mechanism and the tool mounted therein, a locking lever 54 is provided. The lever has a cylindrical head 56 which is internally threaded with brass threads. A suitable bolt extends through a threaded hole in the leg, through an unthreaded hole in the end section of the arm 22, and into the head 56. Once the clamping mechanism has been set at the desired angle either for grinding or for honing the tool blade, it can be secured in this position by turning the locking and lever, thereby effectively clamping the one leg to the side of arm 22.

The tubular support member 24 is welded to the side of the arm near one end as shown. The passage in the support member has a central axis A defining a pivot axis which is perpendicular to a first plane in which the arm is located. A plastic bushing 70 extends along the length of the passage. With this bushing the arm 22 can pivot freely on the mounting bar 28 and can also slide freely back and forth along the bar for a grinding operation.

This known fixture also has a roller arrangement mounted on the arm 22 at one end and on the support member 24. In particular there are two adjustable rollers 64 with only the roller on the end of arm 22 shown. The second roller is mounted on a short roller bearing arm 66 mounted on one end of the support member 24. The axes of the rotation of these rollers are co-axial and these axes are parallel to the pivot axis A. The rollers can contain roller bearings so that they roll freely and easily on a surface. Each roller is mounted on a mounting pin 72.

Figure 2:
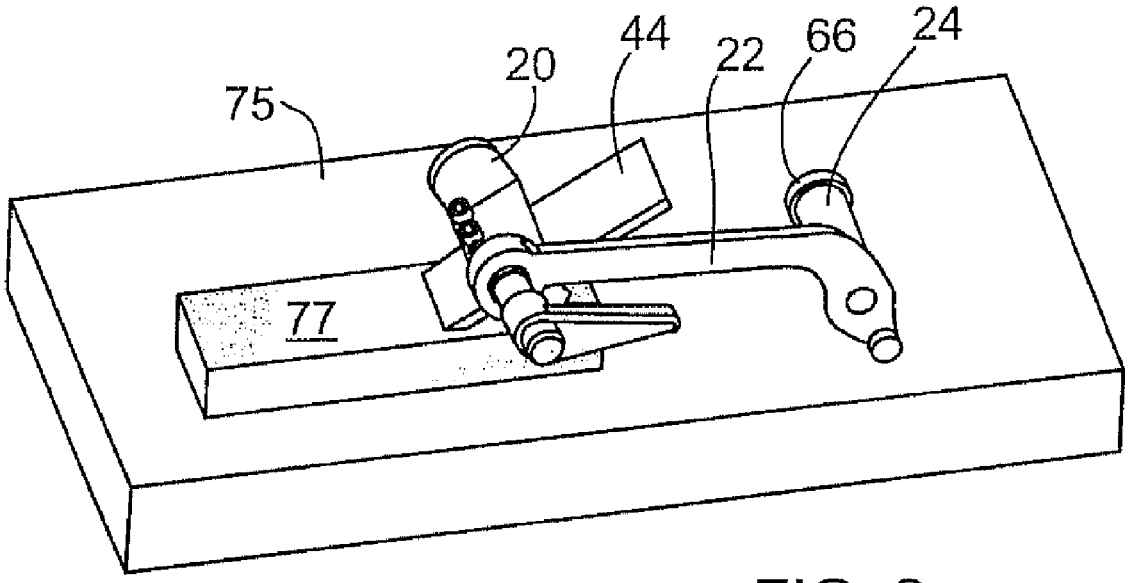
FIG. 2 (PRIOR ART)
FIG. 2 is another perspective view showing how components of the grinding and honing fixture of FIG. 1 can be used to hone a sharp cutting edge on a blade using a honing stone and a flat support surface.
Figure 3:
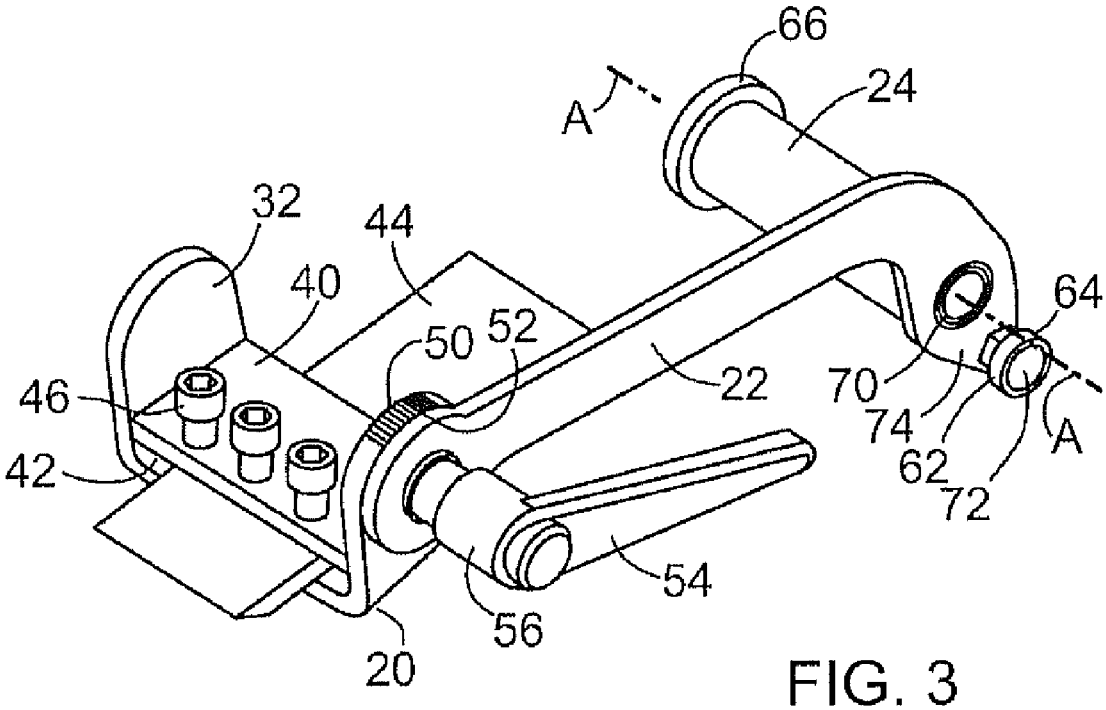
FIG. 3 (PRIOR ART)
FIG. 3 is another perspective view showing the prior art fixture for a honing operation, this view being taken from above and from the front.
Figure 4:
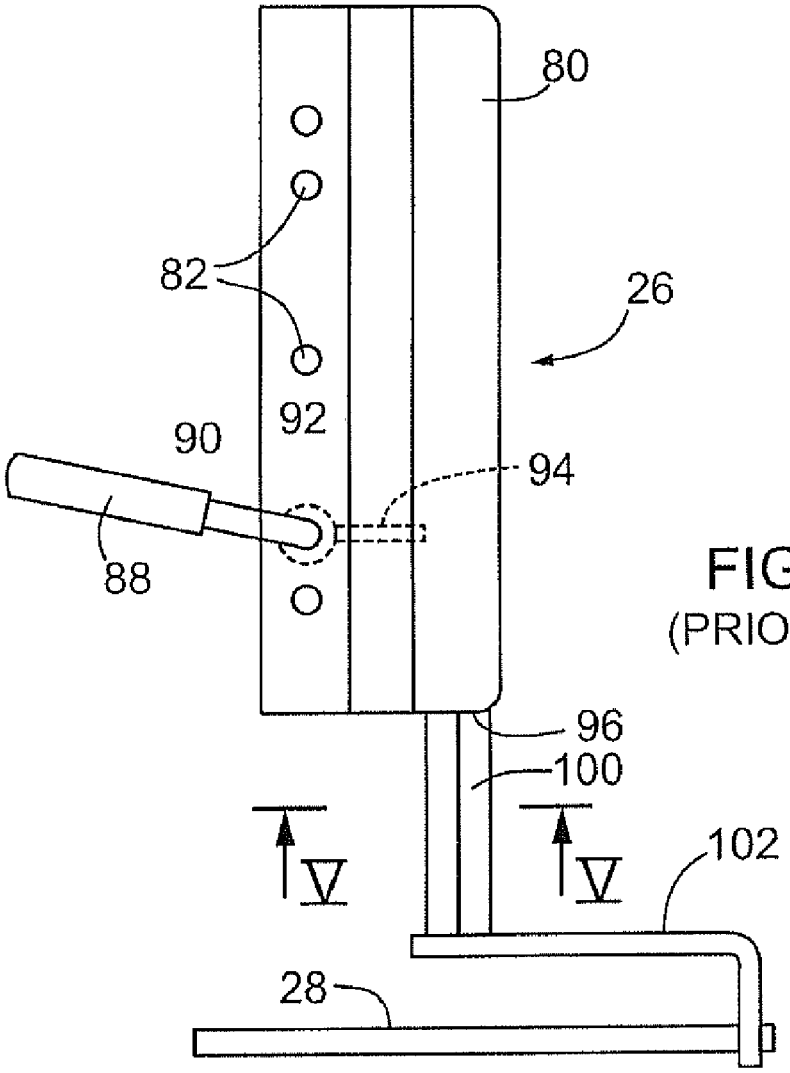
FIG. 4 (PRIOR ART)
FIG. 4 is a top view of a known adjustable mounting bar device used to pivotally mount the fixture shown in FIG. 3.
Figure 5:
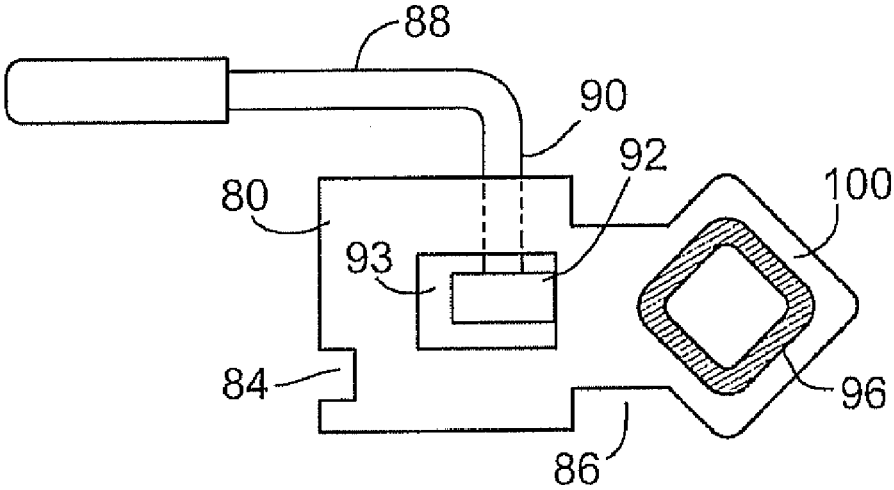
FIG. 5 (PRIOR ART)
FIG. 5 is an end view of the elongate support plate of the mounting bar device with its adjustable horizontal arm shown in vertical cross-section, this cross-section being taken along the line V-V of FIG. 4.

The components of the fixture 10 which are illustrated in FIG. 3 enable a user to carry out a honing operation which is illustrated in FIG. 2. This operation can be carried out on a flat support surface 75 which can be the top of a workbench. Arranged on the support surface is a standard honing stone 77 in the form of a rectangular block having a flat top surface. Once the tool has been set at a correct angle for honing by means of the adjustable clamping mechanism, the cutting edge of the tool can be moved back and forth along the honing stone using the arm 22 and support member 24.

With respect to the mounting bar device which is used for the grinding operation, this known device includes a support structure or plate 80 which has a generally rectangular shape as seen from above and which can be an aluminum extrusion. This known base plate is available from One Way Manufacturing of Stratford, Ontario, Canada. Formed along one side of the structure are a series of mounting holes 82 which are used to attach the plate to a workbench by means of two or more screws. This base plate can be used for a right or a left jig arrangement. One or more elongate grooves 84, 86 can be formed in the exterior of the housing in order to reduce its weight and the material required. A pivotal locking lever 88 has a downwardly bent end section 90 that extends into a hole formed in the housing and it is connected to a round cam 92 positioned in a passageway 93 formed in the structure. By pivotal movement of the lever 88, the cam can be rotated in order to engage and press against a small clamp block 94 movable in and guided by a slot formed in the structure. Formed along one side of the housing 80 is an elongate passage 96 sized to snuggly receive a straight bar or tube 100 that is slidable in the passageway. This bar or tube has a non-circular cross section so that it will not rotate in the passageway. In the illustrated embodiment, the passageway 96 is oriented so that its diagonals extend vertically and horizontally (see FIG. 5). This arrangement allows the clamp block 94 to securely clamp or tube 100 in place without damaging either the housing or the bar. Rigidly attached to the outer end of the tube 100 is an angular support member 102 and rigidly mounted on the outer end of this member is the mounting bar 28.

This known honing fixture can be used to sharpen a blade by first placing a honing stone 77 on a flat surface as shown in FIG. 2 and then setting the angle of the blade at the appropriate angle for honing the final sharp edge of the blade. This is done using the components of the fixture shown in FIGS. 2 and 3. The blade is placed in the clamping mechanism and then the locking lever can be used to loosen the clamp mechanism so that it can be rotated on the arm 22 and then to tighten the clamping mechanism to hold it at the correct angle.

The next step in the sharpening process is to mount the components of the fixture shown in FIG. 3 on the mounting bar 28 by inserting the bar through the passage in the support member 24 as shown in FIG. 1. Then, by using the lever 88 to adjust the position of the bar 100 and the bar 28, the position of the blade vis a vis the grinding wheel 14 is adjusted so that the wheel can grind the basic bevel angle of the blade and clear away the unwanted metal while not touching the cutting edge (unless required for sharpening purposes). The grinding operation is then carried out by sliding the arm 22 and the clamping mechanism back and forth in the horizontal direction along the mounting bar 28 as required. Because the tool is being held in the correct orientation relative to the wheel at all times during the grinding process, the possibility of accidentally touching or damaging the sharp edge of the tool is minimized.

The final step in the sharpening process is to remove the jig components of FIG. 3 from the mounting bar 28 and then arranging the components with the clamped blade in the position shown in FIG. 2 for a final honing operation. Using the roller 64 to roll the jig device back and forth along the fat surface, a fine micro-bevel at a slightly different angle than the basic bevel angle can be produced thereby creating a very sharp blade edge.

Figure 6:
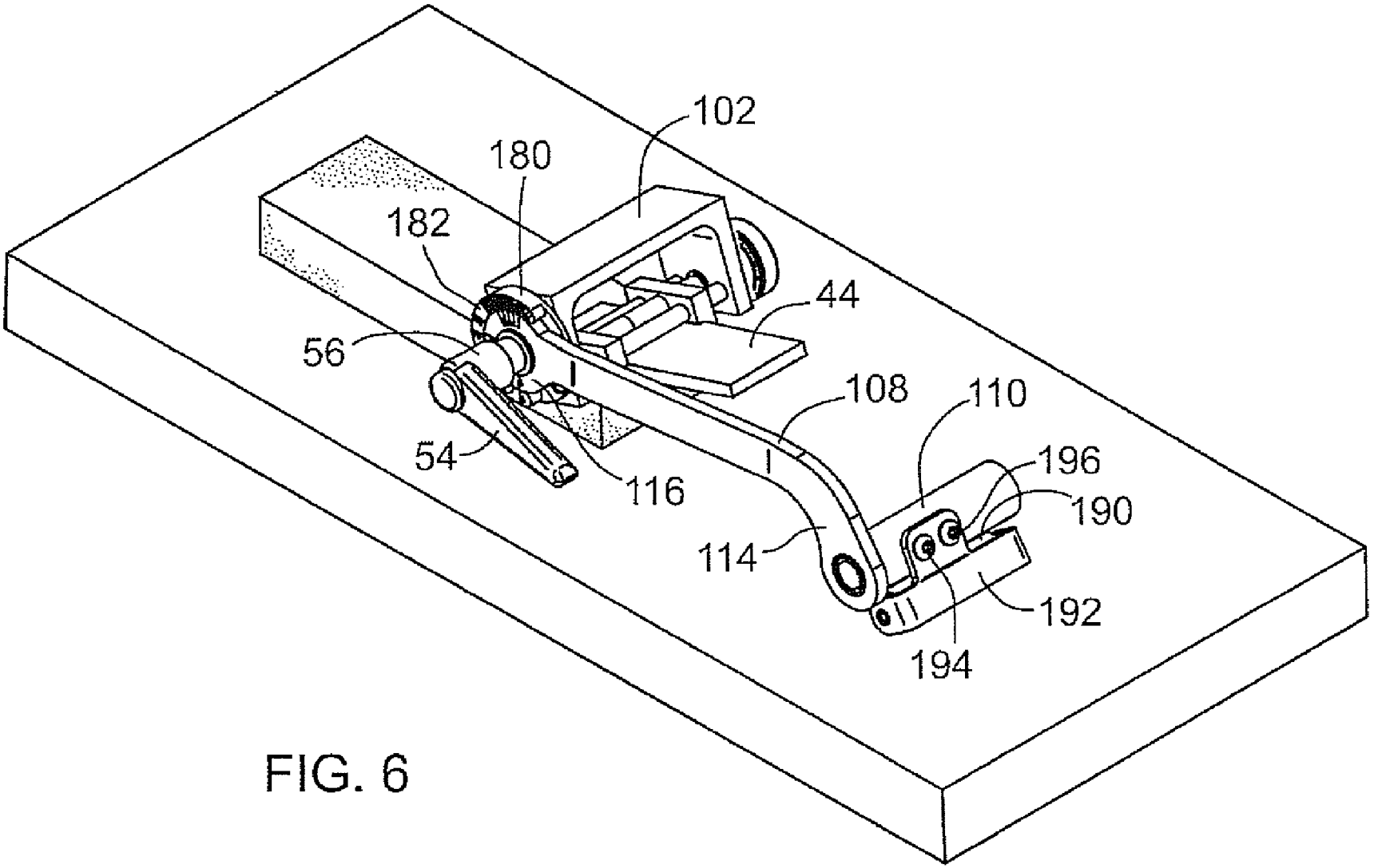
FIG. 6 is a perspective view taken from above and from a rear-end showing a fixture constructed in accordance with the invention being used to hone a tool such as a plane iron.
Figure 7:
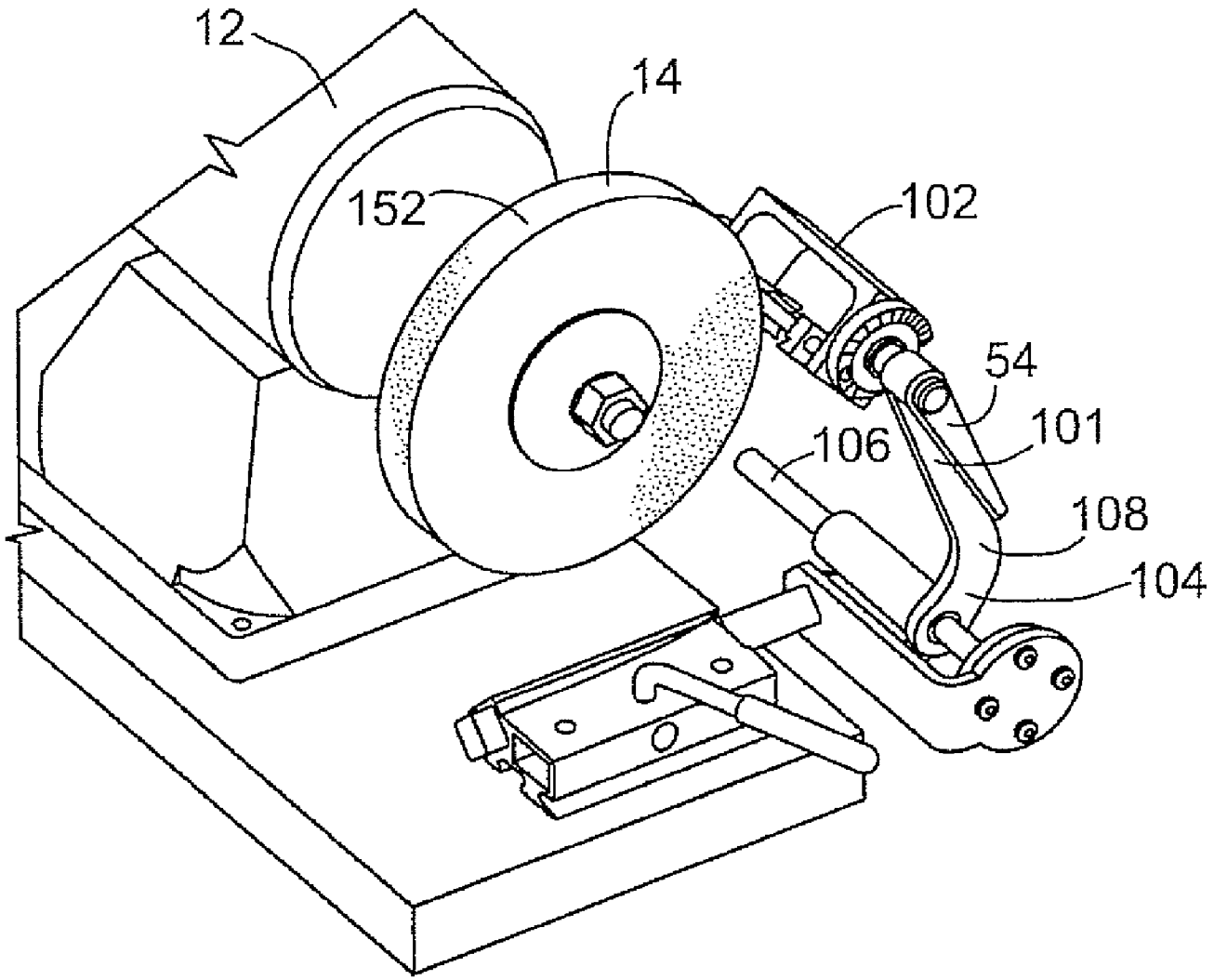
FIG. 7 is another perspective view taken from above showing a grinding fixture constructed in accordance with the invention mounted on work bench for grinding a cutting edge on a tool blade (not shown)

Turning now to the construction of a blade holding jig constructed in accordance with the present invention which is illustrated in FIGS. 6 and 7, a complete blade holding jig that can be used for grinding a blade is indicated at 101. This jig includes a clamp unit 102 which is shown separately in FIGS. 11 to 13 and a support arm mechanism 104. The support arm mechanism is adapted to be pivotally mounted on an elongate guide bar 106 having a circular cross section and a longitudinal axis, this axis being indicated at A in FIG. 9. The support arm mechanism includes an elongate arm 108 which can be formed from a flat metal plate and a tubular support member 110 rigidly mounted on one end of the arm. This support member is open ended so that the guide bar 106 can pass through it as shown. The illustrated exemplary arm is formed with a relatively short end section 114 which extends at all obtuse angle to the main section of the arm. This end section is formed with a rounded bulge to accommodate the attachment of the support member 110 on one side. At the opposite end of the arm, there is a rounded end section 116 having a bolt hole (not shown) formed therein for passage of a bolt used to connect the clamp unit 102.

Figure 8:
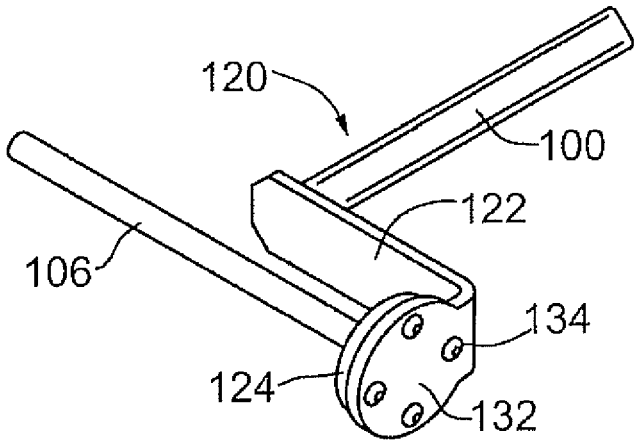
FIG. 8 is a perspective showing a mounting bracket assembly for the blade holding jig shown in FIG. 7.
Figure 9:
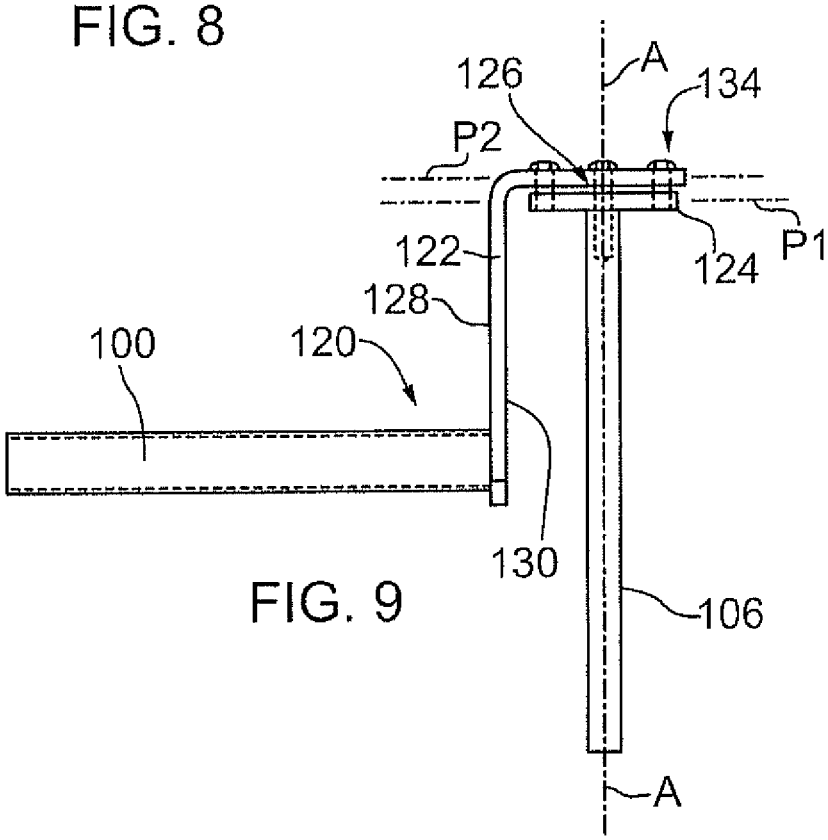
FIG. 9 is a top view of the mounting bracket assembly of FIG. 8.
Figure 10:
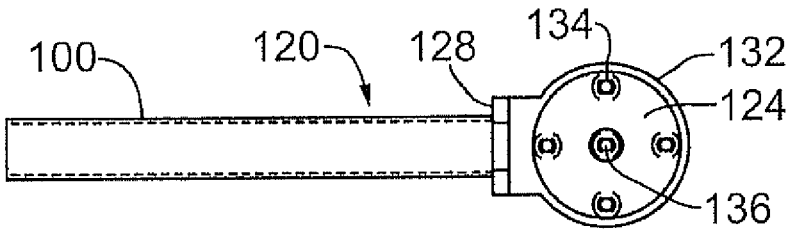
FIG. 10 is a side view of the mounting bracket assembly of FIG. 8.

With reference now to FIGS. 8 to 10, there is shown therein a mounting bracket assembly 120 which includes the guide bar 106 and a support device 122 for rigidly supporting the guide bar. The guide bar has a rocker plate 124 fixedly mounted to one end thereof, extending perpendicular thereto, and extending in first plane indicated at $P_1$ FIG. 9. In the exemplary embodiment shown, this rocker plate is circular and it can be rigidly attached to the bar 106 by means of a button head screw, for example a M6X20 screw. This screw 126 extends into a central, threaded hole formed in the end of the bar. The support device 122 includes an angular support member 128 which as shown is bent to form a right angle and which has a first leg 130 rigidly attached to the end of straight tube 100 which is similar in its construction and arrangement as the tube 100 in the prior art jig of FIG. 1. The support member 128 has a relatively short, substantially flat leg section 132 extending in a second plane $P_2$ which, as shown, extends parallel to the plane $P_1$. The leg section 132 is detachably connected to the rocker plate 124 by adjustable screws 134 which, in the illustrated exemplary embodiment comprise four button head screws which are distributed about a central pivot point on the rocker plate indicated at 136 in FIG. 10. In this embodiment, the pivot point is formed by the projecting rounded head of the screw 126 but the pivot point could be formed by other means. With this arrangement, the first plane $P_1$ of the rocker plate can be angularly adjusted relative to the second plane $P_2$ by turning one or more of the screws 134. This angular adjustment also adjusts the position of the blade 44 when the latter is clamped in the clamp unit 102 and the support arm mechanism is mounted on the guide bar 106.

The provision of the adjustable rocker plate which in turn adjusts the direction in which the guide bar 106 extends allows the adjustment of the orientation of the blade in the clamp unit 102 in a relatively simple and precise manner. The adjustable rocker plate can help avoid the need to adjust the position of the blade in the clamp unit itself and reduce the need to manufacture the jig 101 to precise tolerances.

Figure 11:
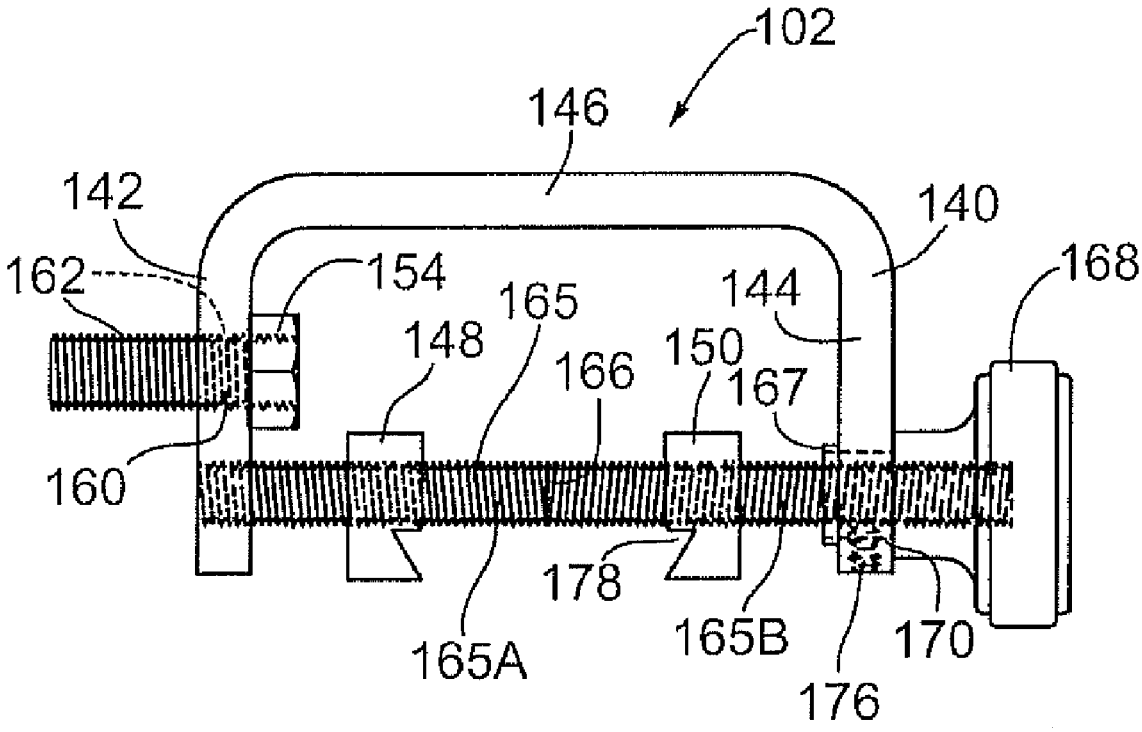
FIG. 11 is a front view of a clamp unit for the blade holding jig.
Figure 12:
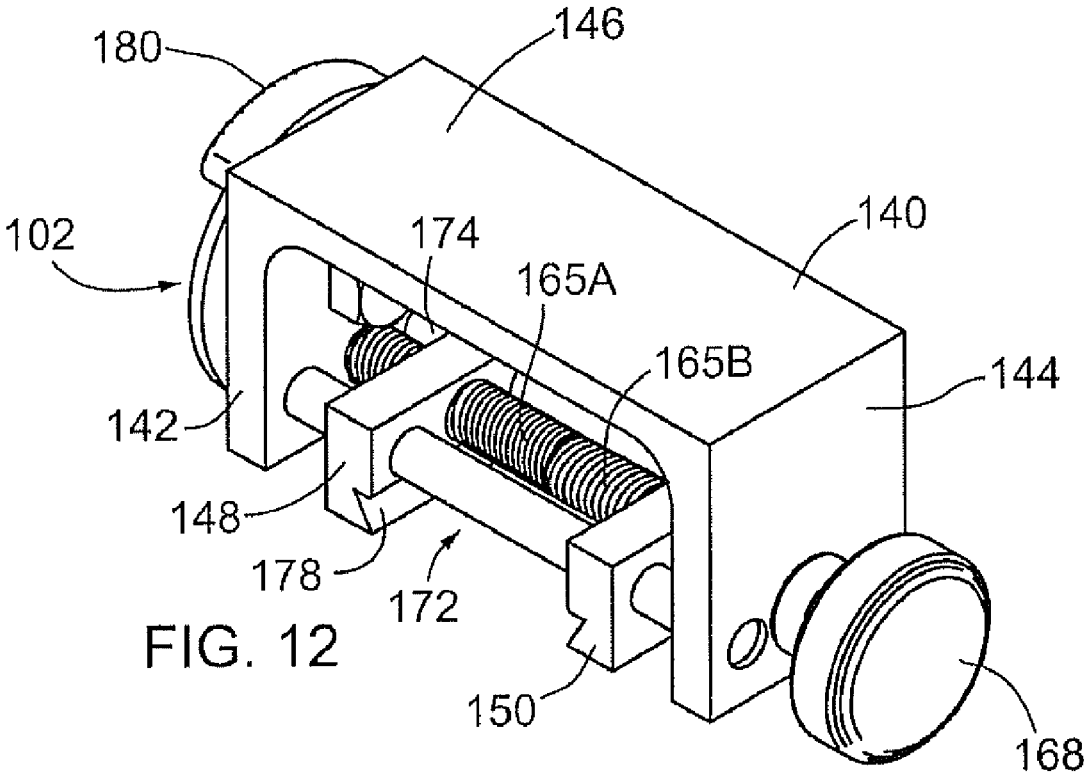
FIG. 12 is a perspective view taken from above of the clamp unit of FIG. 11.
Figure 13:
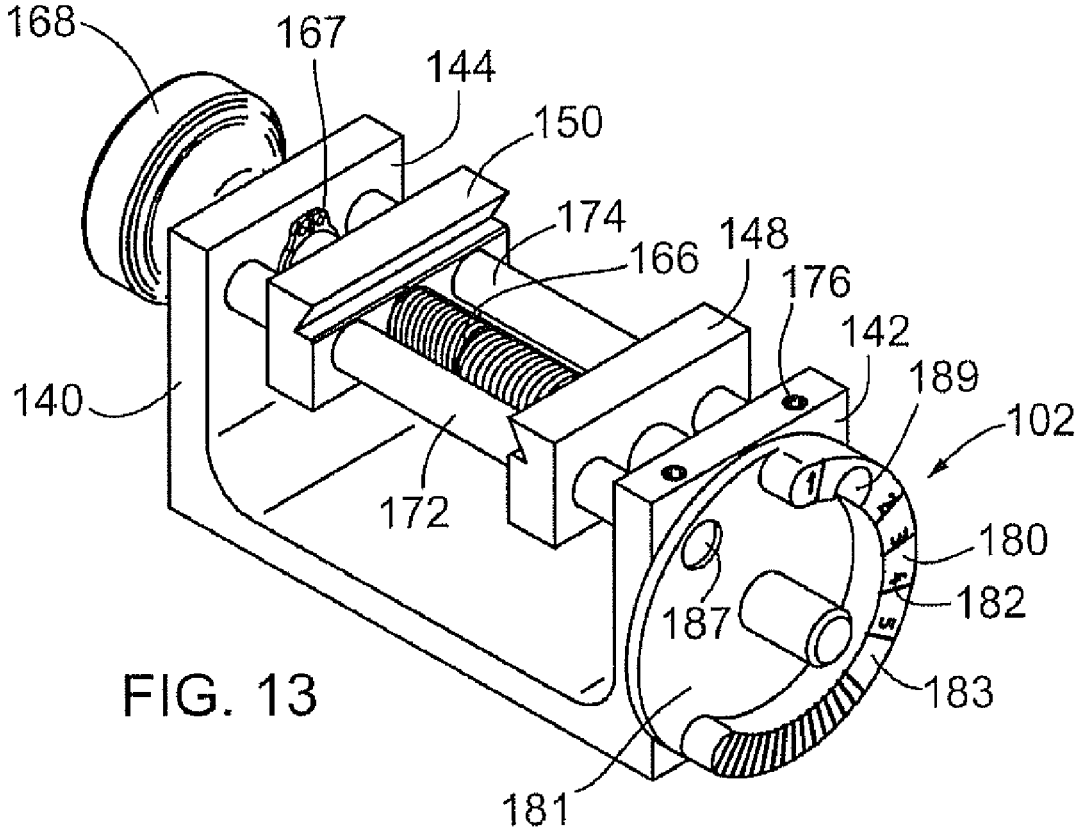
FIG. 13 is a perspective view taken from below of the clamp unit of FIGS. 11 and 12, this view showing the end opposite the end visible in FIG. 12.
Figure 14:
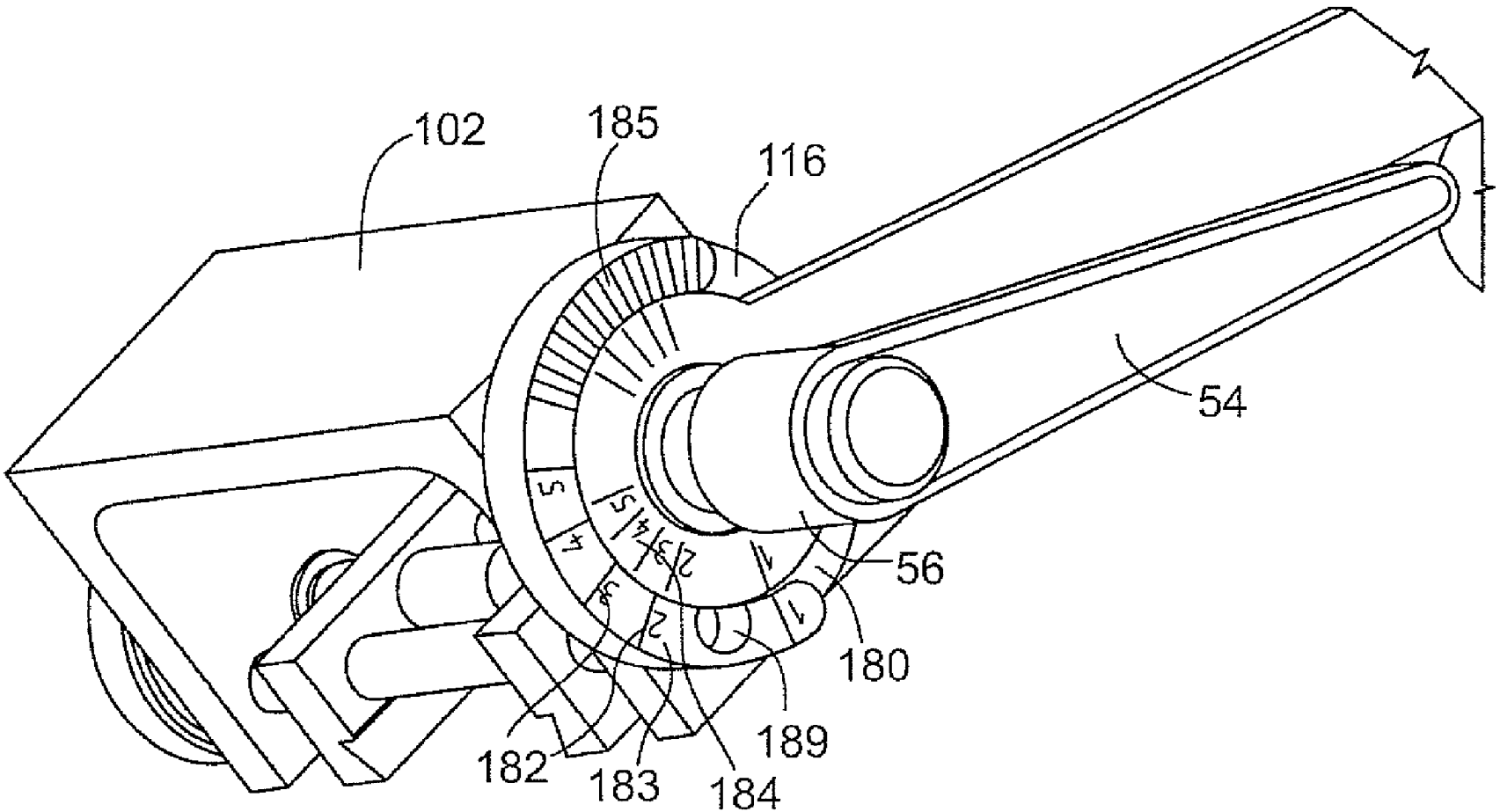
FIG. 14 is a close-up perspective view showing the scales for setting and measuring the angular position of the clamp unit.

Turning now to the construction of the clamp 102 as show in FIGS. 11 to 13 this exemplary version includes U-bracket 140 with two, spaced-apart legs 142, 144 rigidly connected by a bracket end section 146. The clamp unit further includes two clamping jaws 148 and 150 adjustably mounted on the U-bracket between its legs so that the clamping jaws can be moved towards one another to firmly clamp the blade 44 in a position suitable for honing or grinding or moved away from one another to release the blade. The U-bracket is advantageously arranged so that, during use of the jig in a grinding operation using the grinding machine 12 equipped with at least one grinding wheel 14 as shown in FIG. 7, the two legs extend from the bracket end section substantially towards the circumferentially surface 152 of one grinding wheel. Also when the jig components are used for honing the blade edge with a honing stone as shown in FIG. 6, the two legs extend substantially downwardly towards the stone. Because of the orientation of the U-bracket, the jig can be used to grind and hone a relatively short blade or tool because the clamp unit itself does not interfere with the grinding or honing of such a tool.

The U-bracket is adjustably connected to the rounded end section 116 of the arm by an attachment mechanism defining a pivot axis extending perpendicular to the arm so that, during use of the jib for grinding, the clamp unit and the blade 44 can be set at a desired angle for the grinding operation by using the attachment mechanism to adjust the angular position of the clamp unit above the pivot axis to the desired angle. In the illustrated exemplary embodiment, this attachment mechanism includes a bolt 154 mounted in and extending through a hole in one leg 142 of the U-bracket. In one embodiment this bolt is a ⅜ inch hex bolt having a threaded shaft of 1 inch. The bolt shaft is threaded through the hole in the leg 142 and through a hole formed in the rounded end section 116 of the arm and is secured in place by a locking lever 54 similar to that used in the prior art fixture of FIG. 1. The locking lever has an internally threaded cylindrical head 56 which is connected to the outwardly projecting threaded end section of the bolt.

The clamp unit 102 includes a rotatable threaded rod member 165 which extends between and is mounted in the two legs of the U-bracket for the member 165. An exemplary version is formed of two separate rod sections 165A and 165B with section 165A being right hand threaded and section 165B being left hand threaded. The two sections are rigidly connected together, for example by short threaded co-operating male and female end portions at 166. The rod member 165 can be secured against axial movement by a retaining snap ring 167 which fits in a suitable groove formed near one end of the rod member. Instead of this snap ring, a threaded bushing can be used which prevents axial movement of the rod member. The rod section 165A extends through a threaded hole formed centrally in the clamping jaw 148 while the rod section 165B extends through a similar threaded hole formed in the clamping jaw 150. A manually operated turning knob 168 is fixedly connected to one end of the rod member 165 and is located adjacent to and outwardly from the leg 144 of the U-bracket. In an exemplary form of the U-bracket a low friction threaded bush 170 is mounted in the hole of the leg 144 through which the rod member 165 extends. The bush can be made of brass.

The clamp unit also has at least one guide rod extending between and mounted in the two legs of the U-bracket and extending through holes formed in the clamping jaws. In the illustrated exemplary embodiment there are two guide rods 172 and 174. Each of these rods can be secured in the U-bracket by a set screw 176 that is threaded into a respective hole formed in the end of the leg 142. The two guide rods guide the movement of the clamping jaws and prevent these jaws from rotating about the rod member 165. Because of the different threads on the two rod sections 165A and 165B, rotation of the rod member 165 in a clockwise direction will move the clamping jaws towards one another and rotation of the rod member in an opposite direction moves the clamping jaws apart from each other. The exemplary jaws as shown each have an inner surface formed with a V-shaped notch 178 to engage a respective one of two opposite edges of the blade 44. The angle shape of a notch forces the tool or blade to nest securely between the jaws when clamping pressure is applied by clockwise rotating the knob 168. It is of course possible to altar the shape of the inside surface of the jaws or to provide a different notch shape to accommodate particular tools or blades to be ground and honed.

The jig 101 also provided with a good angle setting arrangement for setting the angle of the clamp unit relative to the aim 108 on which it is mounted. In particular the jig includes a disc-like, angle measuring member 180 mounted on outer surface of the leg 142 of the U-bracket. The member 180 can be machined from aluminum and then black anodize coated. It is then laser etched with the illustrated graduations 182. The member 180 is attached to the adjacent leg by protruding ends of the guide rods 172, 174 which extend into two holes 187, 189 machined into the member 180. It is tightened in place by the lever 54. The exemplary member 180 has a round, flat base 181 and an arc-shaped rim section 183 extending through an arc exceeding 180 degrees. The rounded end section 116 of the arm fits snuggly within the rim section. The angle measuring member has the scale graduations 182 formed on an outer side thereof, and on the flat top of the rim section 183. Additional scale markings 184 are provided on the rounded end section 116 of the arm adjacent the scale graduations 182. The markings 184 can be machined on the arm by a CNC milling machine. These additional markings are used in conjunction with the markings 182 to indicate a selected angular setting. The scale graduations can include both principal markings which are relatively widely spaced and finer markings 185 which are more closely spaced. In an exemplary embodiment, repetitive angular adjustment between the clamp unit and the arm 108 is possible by the use of the scale markings 182, 184, 185. In the illustrated embodiment, the widely spaced markings are labeled from 1 to 5 on both the arm and the disc-like member 180. In the illustrated exemplary embodiment, the two scales are set up as a vernier scale which will allow a 1 degree repetition of position. As the arrangement and use of vernier type scales is known in the measuring instrument art, a detailed description herein is deemed unnecessary.

Figure 15:
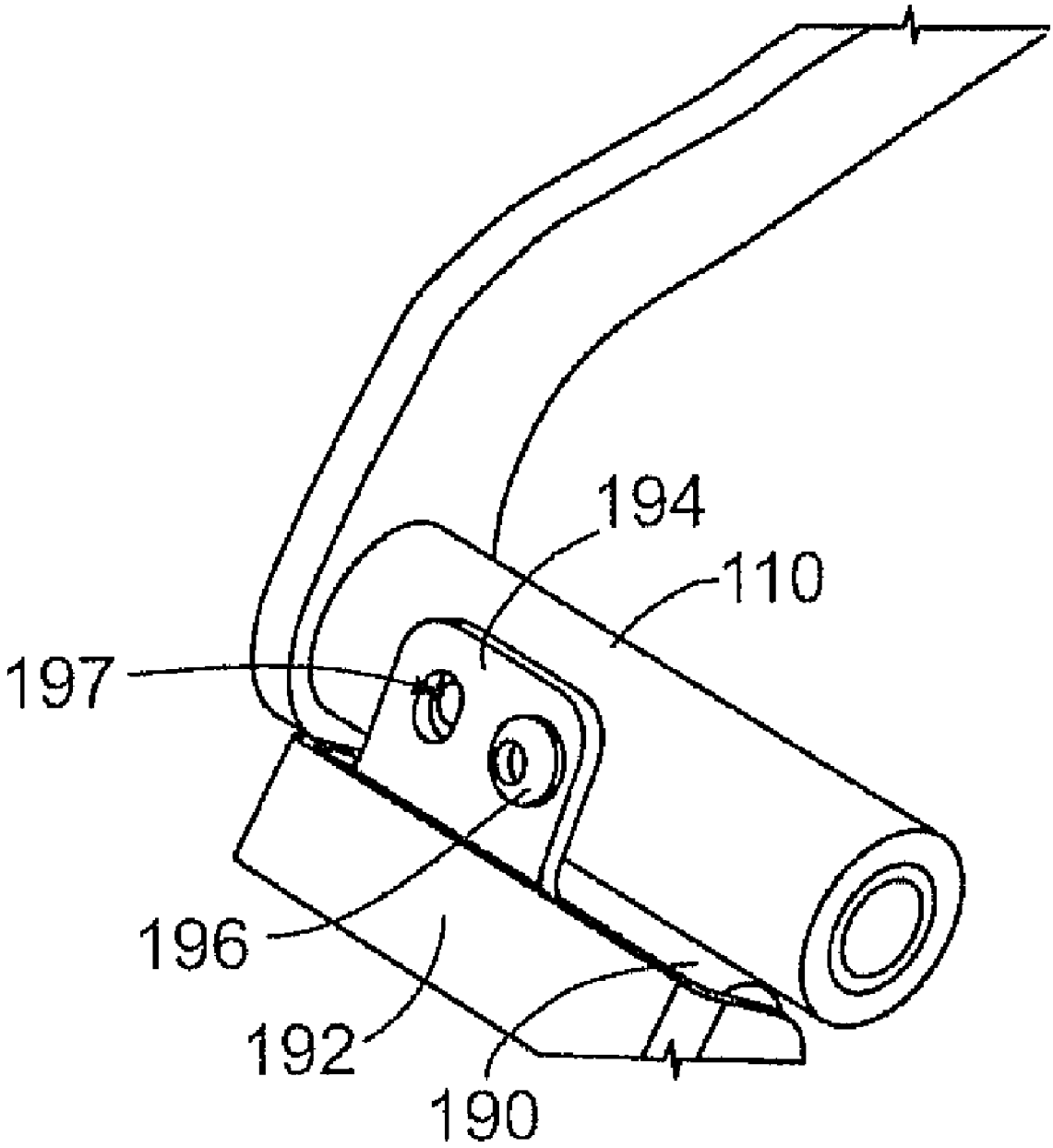
FIG. 15 is a perspective detail view showing the manner in which the roller of the fixture is adjustably mounted.

For the honing process shown in FIG. 6, either two adjustable rollers can be provided as in the prior art fixture 10 of FIG. 2 or a single elongate roller 190 which is adjustable with respect to the relative position of its central axis of rotation in order to prevent rocking when the fixture is used for honing. The roller 190 can be mounted on the side of support member 110 by metal bracket 192 having a connecting tab 194. Two screws 196 can connect the tab to the support member. FIG. 15 illustrates how the axis of rotation of the roller 190 can be adjusted. In this Figure, one of the screws 196 has been removed to show an elongate screw hole 197 formed in the tab 194. The roller position can be adjusted plus or minus 10 degrees by loosening the two screws and then setting the angle of the roller to match the bevel of the blade to be honed. The screws are then re-tightened.

Except for the differences in construction and use as already noted above, the grinding and honing fixture or jig 101 is used to sharpen the edge of a blade in a manner similar to the sharpening process described above in connection with fixture 10 both in the form shown in FIG. 1 and in the form shown in FIG. 2. It will be understood that the tubular support 100 for the jig or fixture of FIGS. 6 and 7 is adjustably mounted on a workbench or table in the same manner as the jig 10 shown in FIG. 1.

It will be appreciated by those skilled in the construction of grinding and honing fixtures that various modifications and changes can he made to the above described fixture without departing from the spirit and scope of this invention. Accordingly all such modifications and changes that fall within the scope of the accompanying claims are intending to be part of this invention.

The invention claimed is:

1. A blade holding jig for grinding a blade with a grinding machine, comprising:

a mounting bracket assembly including an elongate guide bar and a support device for rigidly supporting said guide bar;

a support arm mechanism adapted to be pivotably mounted on said guide bar, said support arm mechanism including an elongate arm having a longitudinal axis and a tubular support member rigidly mounted to one end of the arm and extending perpendicular to said longitudinal axis, said tubular support member forming a guide passageway through which said guide bar extends during use of said jig for a grinding operation, said support arm mechanism being slidable along said guide bar during use of said jig; and a clamp unit capable of clamping said blade for the grinding operation, said clamp unit being attached to an end section of said arm remote from said one end of the arm and including a U-bracket with two, spaced-apart legs and two clamping jaws adjustably mounted on said U-bracket between said legs so that said clamping jaws can be moved towards one another to firmly clamp said blade or moved away from one another to release said blade.

2. A blade holding jig according to claim 1 wherein said U-bracket is adjustably connected to said end section of said arm by an attachment mechanism defining a pivot axis extending perpendicular to said arm so that, during use of said jig for grinding, said clamp unit and the blade can be set at a desired angle for the grinding operation by using said attachment mechanism to adjust the angular position of the clamp unit about said pivot axis to the desired angle.

3. A blade holding jig according to claim 2 wherein said attachment mechanism includes a bolt mounted in and extending through a hole in one leg of the U-bracket and a hole formed in said end section of the arm and a locking lever with an internally threaded, cylindrical head connected to an outwardly projecting threaded end section of said bolt.

4. A blade holding jig according to claim 3 including a disk-like, angle measuring member mounted on an outer surface of said one leg of the U-bracket and having scale graduations formed on an outer side thereof, wherein additional scale markings to indicate a selected angular setting are provided on said end section of the arm adjacent the scale graduations.

5. A blade holding jig according to claim 2 wherein, during use of said jig for a grinding operation using said grinding machine equipped with a grinding wheel, the two legs of said U-bracket extend substantially towards the circumferential surface of the grinding wheel.

6. A blade holding jig according to claim 2 wherein each clamping jaw has an inner surface formed with a V-shaped notch to engage a respective one of two opposite edges of said blade.

7. A blade holding jig according to claim 1 wherein said clamp unit includes a rotatable threaded rod member extending between and mounted in said two legs and extending through threaded holes formed in said clamping jaws and at least one guide rod extending between and mounted in said two legs and extending through holes formed in said clamping jaws, wherein rotation of said threaded rod member in one direction moves the clamping jaws towards one another and rotation of said threaded rod member in an opposite direction moves the clamping jaws apart from each other.

8. A blade holding jig according to claim 7 wherein said clamp unit includes a manually operable turning knob fixedly connected to one end of said threaded rod and located adjacent to and outwardly from one leg of the U-bracket.

9. A blade holding jig according to claim 1 wherein said guide bar has a rocker plate fixedly mounted to one end thereof, extending perpendicular thereto, and extending in a first plane, said support device includes an angular support member having a substantially flat leg section extending in a second plane and connected to said rocker plate by adjustable screws distributed about a central pivot point of the rocker plate, whereby said first plane of the rocker plate can be angularly adjusted relative to the second plane by turning one or more of said screws, said angular adjustment also adjusting the position of the blade when the latter is clamped in the clamp unit and the support arm mechanism is mounted on said guide bar.

10. A blade holding jig for honing a blade to provide a sharp edge, comprising:

a support arm mechanism having an elongate arm member with a first longitudinal axis and a tubular support member mounted on one end of said arm member and defining a central, second longitudinal axis which is perpendicular to the first longitudinal axis;

a clamp unit for clamping said blade during a honing process, said clamp unit including a U-bracket with two spaced-apart legs rigidly connected by a bracket end section and two clamping jaws adjustably mounted on said U-bracket between said legs so that said clamping jaws can be moved towards one another to firmly clamp said blade in a position suitable for honing or moved away from one another to release said blade; and an attachment mechanism for adjustably connecting one of said legs to an end section of said arm member located opposite said one end, wherein, during use of said jig for honing, said clamp unit and the blade clamped therein can be set at a desired angle for the honing operation by using said attachment mechanism.

11. A blade holding jig according to claim 10 including an elongate roller mounted on said support arm mechanism adjacent said one end of the arm member and having an axis of rotation parallel to the second longitudinal axis, wherein said roller rotatably engages a flat support surface in order to hold the jig in a desired orientation during said honing operation.

12. A blade holding jig according to claim 11 wherein said roller is mounted on said tubular support member and the position of said roller is adjustable relative to said tubular support member in order to adjust the position of the edge of the blade to be honed relative to a honing stone surface prior to a honing operation.

13. A blade holding jig according to claim 10 including an angle measuring member mounted on an outer surface of said one leg of the U-bracket and having scale graduations forming on an outer side thereof, and scale markings to indicate a selected angular setting on said end section of the arm member adjacent said scale graduations, wherein a vernier scale arrangement is provided by said scale graduations and said scale markings.

14. A blade holding jig according to claim 10 wherein said clamp unit includes an adjusting mechanism comprising a threaded, rotatable rod member having both right hand and left hand threaded sections extending between and mounted in said two legs and extending through threaded holes formed on said clamping jaws and a guide arrangement mounted on said U-bracket for guiding movement of said clamping jaws.

15. A blade holding jig according to claim 10 wherein, during use of said jig for the honing operation using a honing stone, the two legs of said U-bracket extend from said bracket end section and substantially towards a honing surface of the honing stone.

16. A blade holding jig for grinding a blade with a grinding machine, comprising:

a mounting bracket assembly including a guide bar member having an elongate guide bar and a rocker plate fixedly mounted to one end of the guide bar and extending perpendicular thereto, said assembly also including a support device for rigidly supporting said guide bar member, said support device comprising an angular support member with a substantially flat leg section extending in a plane and connected to said rocker plate by an adjustment mechanism whereby said rocker plate can be angularly adjusted relative to said plane of the leg section, thereby altering a direction in which said guide bar extends;

a support arm mechanism adapted to be pivotably mounted on said guide bar and including an elongate arm and a tubular support member rigidly mounted on one end of said arm and extending perpendicular thereto, said tubular support member forming a passage through which said guide bar extends during use of said jig for a grinding operation; and a clamp unit capable of clamping said blade and connected to an end section of said arm opposite said one end of the arm.

17. A blade holding jig according to claim 16 wherein said adjustment mechanism comprises a plurality of adjustable screws distributed about a central pivot point on the rocker plate and connecting said rocker plate to the leg section, whereby said rocker plate can be angularly adjusted by turning one or more of said screws.

18. A blade holding jig according to claim 16 wherein said clamp unit includes a U-bracket with two spaced-apart legs and two clamping jaws adjustably mounted on said U-bracket between said legs so that said clamping jaws can be moved towards or away from one another.

19. A blade holding jig according to claim 18 wherein, during use of said jig for a grinding operation using said grinding machine equipped with a grinding wheel, the two legs of said U-bracket extend from a connecting section of the U-bracket substantially towards the circumferential surface of the grinding wheel.

20. A blade holding jig according to claim 16 wherein said clamp unit is adjustably mounted on said end section of the arm so that said clamp unit and a blade mounted therein can be set at a desired angle for the grinding operation relative to a pivot axis extending perpendicular to the length of the aim.

* * * * *